US005293825A

United States Patent [19]

Cauffiel

[11] Patent Number: 5,293,825

[45] Date of Patent: Mar. 15, 1994

[54] TV TABLE

[76] Inventor: Ford B. Cauffiel, 4126 Nantucket Dr., Toledo, Ohio 43623

[21] Appl. No.: 950,142

[22] Filed: Sep. 24, 1992

[51] Int. Cl.[5] ..... A47B 23/00

[52] U.S. Cl. ..... 108/49; 108/42

[58] Field of Search ..... 297/144, 135, 430, 423, 297/438, 434, 170, 172; 108/42, 49, 144, 106

[56] References Cited

U.S. PATENT DOCUMENTS

| | | | |
|---|---|---|---|
| 2,681,840 | 6/1954 | Miller | 108/89 X |
| 2,710,051 | 6/1955 | Greenberg | 108/49 X |
| 2,749,197 | 6/1956 | Smith | 108/49 X |
| 3,698,328 | 10/1972 | Weir | 108/49 X |
| 3,894,709 | 7/1975 | Weir | 108/49 X |
| 5,038,434 | 8/1991 | Navarrette | 108/49 X |
| 5,104,907 | 2/1993 | Wilkinson | 297/438 X |
| 5,129,702 | 7/1992 | Ervin | 297/149 |
| 5,181,681 | 1/1993 | Edwards | 108/144 X |

FOREIGN PATENT DOCUMENTS

| | | | |
|---|---|---|---|
| 3742813 | 7/1989 | Fed. Rep. of Germany | 108/49 |

*Primary Examiner*—Jose V. Chen

*Attorney, Agent, or Firm*—Allen D. Gutchess, Jr.

[57] ABSTRACT

A TV table assembly for use with a chair has a base plate of a sufficient size to fit under a front leg and a back leg on one side of the chair. A lower sleeve is affixed to and extends upwardly from a forward portion of the base plate. A post has a lower end removably received in the sleeve. A table has a first U-shaped bracket extending downwardly from a lower surface thereof near one end. A second U-shaped bracket has upwardly-extending flanges positioned adjacent the downwardly-extending ones. An upper sleeve is affixed to the second bracket and extends downwardly to removably receive an upper end of the post. A threaded connector extends through both sets of flanges to hold the table in a fixed position relative to a horizontal plane, when tightened. Parallel walls extend upwardly from the base plate and rearwardly of the lower sleeve to serve as a magazine rack.

10 Claims, 1 Drawing Sheet

TV TABLE

This invention relates to a TV table assembly for use with a chair.

Various tables designed for use with chairs are known in the art. These include U.S. Pat. No. 3,179,071, issued Apr. 20, 1965; U.S. Pat. No. 3,717,375, issued Feb. 20, 1973; U.S. Pat. No. 3,879,084, issued Apr. 22, 1975; and U.S. Pat. No. 5,,035,464, issued Jul. 30, 1991. With all of these tables, the supporting structure is affixed to the floor adjacent the chair or affixed to the chair itself. Other miscellaneous tables are disclosed in U.S. Pat. No. 3,715,995, issued Feb. 13, 1973, and U.S. Pat. No. 4,359,004, issued Nov. 16, 1982.

The present invention relates to a TV table assembly is for use with a chair which can be separated completely from the chair for storage or for use with another chair. The table assembly includes an elongate base plate of a sufficient size to fit under a front leg and a back leg or other supportive structure on one side of the chair and can be removed simply by tilting the chair. A lower supporting sleeve is affixed to a forward portion of the base plate and extends upwardly therefrom. A post has a lower end removably received in the sleeve and can be separated therefrom.

A TV table is supported by the post and base plate. The table has a first U-shaped bracket affixed to the bottom of the table near one end thereof. The bracket includes two downwardly-extending flanges. A second U-shaped bracket has upwardly-extending flanges positioned adjacent the downwardly-extending ones. An upper sleeve is affixed to a web of the second bracket and extends downwardly to removably receive an upper end of the post so that the bracket and post can be separated. This enables them to be readily stored in a closet or the like, when desired. A threaded connector extends through both the downwardly-extending flanges and the upwardly-extending ones and is turned by a suitable knob. When the threaded connector is tightened, it holds the table in a fixed position. The table can be tilted to enable it to support reading material in addition to serving as a support for food and refreshments when in a horizontal plane. The table, of course, can also be pivoted in a horizontal plane to an out-of-the-way position when not in use.

It is, therefore, a principal object of the invention to provide a TV table assembly for use with a chair, which assembly can be partly or completely separated from the chair.

Another object of the invention is to provide a TV table assembly, components of which can be readily separated for storage.

Yet another object of the invention is to provide a table assembly for use with a chair in which the table can be tilted to an angular position to support reading material.

Various other objects and advantages of the invention will be apparent from the following detailed description of a preferred embodiment thereof, reference being made to the accompanying drawings, in which.

Figure 1:
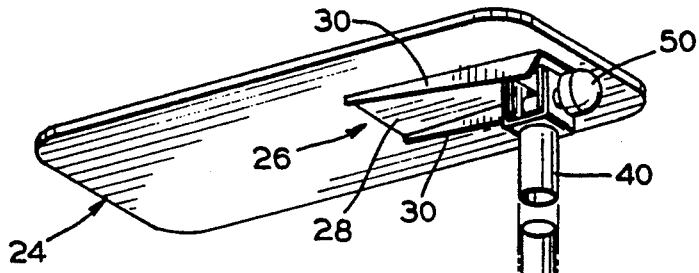
FIG. 1 is an exploded view in perspective of a TV table assembly in accordance with the invention.

Referring to the drawing, a TV table assembly in accordance with the invention is indicated at 10. It includes a base plate 12 of a sufficient size to be placed under chair supports on one side of a chair 14. The supports can be front and rear legs or runners that extend the full length of the chair. In either event, the base plate is supported and held in position by one side of the chair. More specifically, the base plate 12 includes a narrow portion 16 extending rearwardly from a wide portion 18. A cup-shaped, lower sleeve 20 extends upwardly from an outer forward portion of the wide portion 18 of the base 12. It can be affixed to the base plate 12 by a threaded fastener and bolt (not shown).

A post 22 has a lower end removably received in the lower sleeve 20 and can pivot relative thereto as well as be removed. The post 22 can be of wood with a suitable finish and is of suitable length, eg. twenty-two inches.

Figure 3:
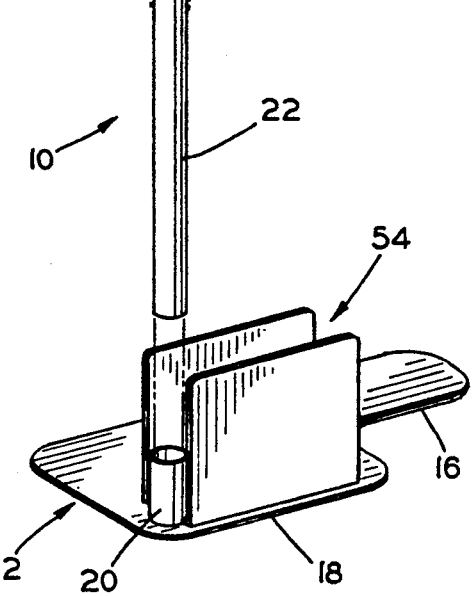
FIG. 3 is a fragmentary view in elevation taken along the line 3—3 of FIG. 2.
Figure 3:
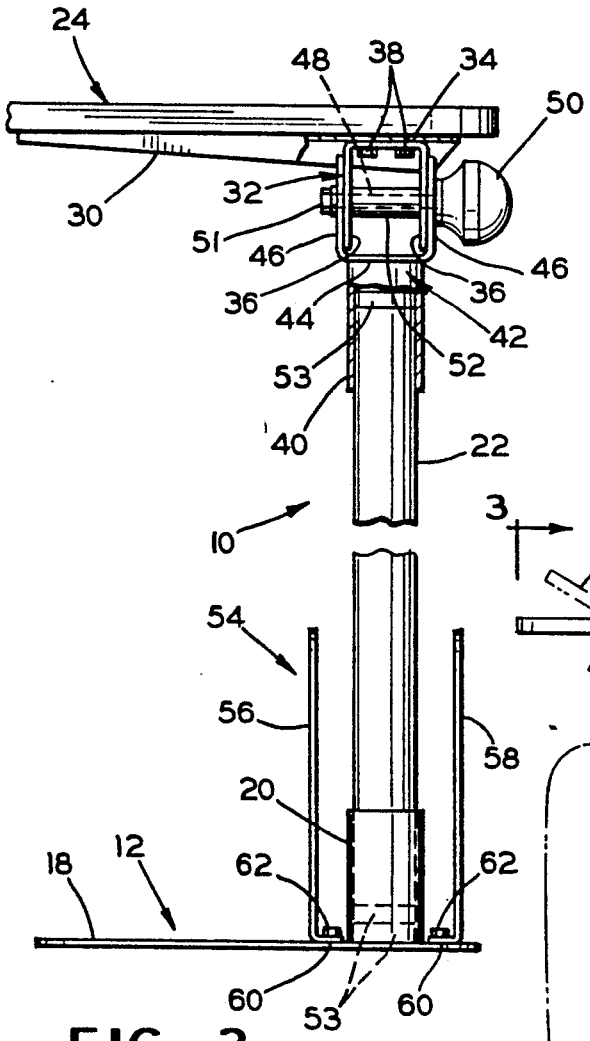

The TV table assembly 10 also includes a table 24 which is elongate in shape and of an ample size to comfortably hold food and refreshment, being thirteen inches wide and thirty-one inches long, for example. The table 24 can also be of wood having an attractive finish thereon. A supporting bracket 26 is located at an end portion of the table 24. It has a web 28 which is suitably affixed to the bottom surface of the table 24 by suitable threaded fasteners (not shown) and has tapered side flanges 30. A first U-shaped bracket 32 is also located at the one end of the table 24. It has a web 34 with downwardly-extending, parallel flanges 36. The web 34 is affixed to the web 28 of the supporting bracket 26 by short threaded fasteners (not shown) and nuts 38 (FIG. 3).

Figure 2:
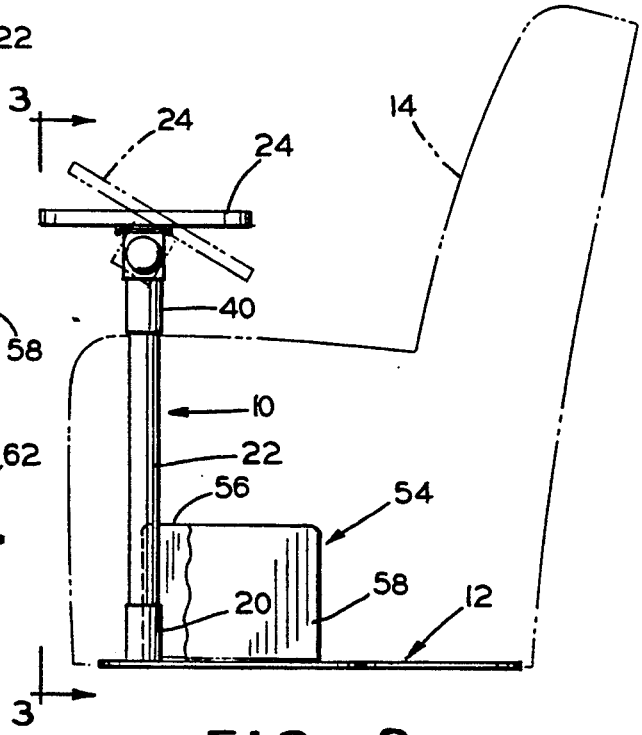
FIG. 2 is a side view in elevation of the TV table assembly, showing the table in a slanted position in dotted lines and showing a chair in dotted lines.

An upper cup-shaped sleeve 40 is removably received on the upper end of the post 22 and can pivot relative to the post and can also be separated therefrom. The table 24 and the post 22 can then be easily separated from each other and from the base plate 12 so as to be stored in a closet or the like when not needed. A second U-shaped bracket 42 has a web 44 and upwardly-extending flanges 46. The bracket 42 is affixed to the upper end of the sleeve 40 by a suitable threaded fastener and nut (not shown). The flanges 46 extend upwardly in contiguous relationship with the flanges 36 of the first bracket 32 and have aligned holes therein. A threaded. shank 48 extends through these holes and is affixed to a knob SO. The other end of the shank extends beyond the brackets 32 and 42 and is received in a nut 51. The shank 48 also extends through a tube 52 located between the flanges 36. The knob can be turned to loosen the brackets to place the table 24 in a slanted position, as shown in dotted lines in FIG. 2, and then tightened to hold the table in that position. In such position, the table is functional to support reading material and the like for a person sitting in the chair 14.

The height of the table 24 can also be adjustable, if desired. This can be accomplished, for example, by using inch thick spacer blocks 53 (FIG. 3) above and/or below the ends of the post 22. Also, the post 22 can be of tubular, two-piece, telescoping construction. A screw can be carried at an end portion of the lower tube to hold the tubes in fixed, telescoping relationship.

A rack for magazines or the like indicated at 54 can be located on the outer portion of the wide portion 18 of the base plate 12. The rack 54 includes two parallel upright panels 56 and 58 extending upwardly from the base plate on either side of the lower sleeve 20 and extending rearwardly therefrom. The panels 56 and 58 have flanges 60 which can be affixed to the base plate by short, flat-headed screws (not shown) received in nuts 62. The panels 56 and 58 of the rack 54 also help to hide or partially hide the sleeve 20, when the post 22 and the table 24 are removed.

From the above, it will be seen that the TV table assembly according to the invention can be readily separated for storage and the base plate can be removed and used with another chair at another location. The magazine rack has separate utility, even when the table and post are removed. The table 24 can be used in a horizontal position for food and refreshment or in a tilted position for reading material. The table can also be readily swung out of the way before a person sits down in or rises from the chair.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A table assembly for use with a chair, said assembly comprising stabilizing means defined by a base plate to be received under and held stationary by chair supports on at least one side of a chair for supporting said assembly, said base plate having a bottom surface for defining a floor engaging means contacting a floor under the chair, an upright post, a lower sleeve affixed to and extending upwardly from said base plate to receive a lower end of said post, said post being pivotal relative to said lower sleeve, a table having an upper flat surface, an upper sleeve extending downwardly from an end portion of said table, said upper sleeve receiving an upper end of said post so that said table is pivotable in a horizontal plane relative to said base plate.

2. A table assembly according to claim 1 wherein bracket means connects said upper sleeve and said table to enable said table to be moved to a slanted position relative to the horizontal, said bracket means having adjacent flanges, and threaded means extending through said flanges to hold said table in a fixed position relative to the horizontal, said threaded means including a knob for turning said threaded means to tighten and loosen said flanges to enable said table to be tilted and fixed in a given position.

3. A table assembly according to claim 1 wherein means are associated with said post to adjust the height of said table.

4. A table assembly for use with a chair, said assembly comprising stabilizing means defined by a base plate of sufficient size to be received under and held stationary by chair supports on at least one side of a chair for supporting said assembly, said base plate having a bottom surface defining a floor engaging means for contacting a floor under the chair, an upright post, first means on said base plate to support a lower end of said post on said plate, a table, second means extending downwardly from an end portion of said table to support said table on an upper end of said post, said post and at least one of said first and second means enabling said table to pivot in a substantially horizontal plate relative to said plate.

5. A table assembly according to claim 4 wherein said base plate has a narrow rear portion and a wide forward portion with said first means located toward an outer edge of said wide portion away from the chair.

6. In combination, a table assembly and a chair, said assembly comprising stabilizing means defined by a base plate received under and held stationary by chair supports on at least one side of said chair for supporting said assembly, said base plate having a bottom surface defining a floor engaging means for contacting a floor under the chair, an upright post, first means extending upwardly from said base plate to support a lower end of said post on said plate, said post being pivotal on a vertical axis relative to said first means and said plate, a table having an upper flat surface and being elongate in shape and of ample size to hold food, second means extending downwardly from an end portion of said table to support said table on an upper end of said post so that said table is pivotable in a horizontal plane relative to said base plate, and means associated with said post to adjust the height of said table relative to said base plate.

7. The combination according to claim 6 wherein said base plate has a narrow rear portion and a wide forward portion with said first means located toward an outer edge of said wide portion away from the chair.

8. A table assembly for use with a chair, said assembly comprising stabilizing means defined by a base plate to be received under chair supports on at least one side of a chair for supporting said assembly, said base plate having a bottom surface defining a floor engaging means for contacting a floor under the chair, an upright post, a lower sleeve affixed to and extending upwardly from said base plate to receive a lower end of said post, a table having an upper flat surface, an upper sleeve extending downwardly from an end portion of said table, said upper sleeve receiving an upper end of said post so that said table is pivotable in a horizontal plane relative to said base plate, said base plate having a narrow rear portion and a wide forward portion with said lower sleeve located toward an outer edge of said wide portion away from the chair, and a magazine rack affixed to said wide portion adjacent said lower sleeve, said magazine rack comprising two panels affixed to said wide portion and extending upwardly on either side of said lower sleeve.

9. A table assembly for use with a chair, said assembly comprising stabilizing means defined by a base plate of a sufficient size to be received under chair supports on at least one side of a chair for supporting said assembly, said base plate having a bottom surface defining a floor engaging means, an upright post, first means on said base plate to support a lower end of said post on said plate, said base plate having a narrow rear portion and a wide forward portion with said first means located toward an outer edge of said side portion away from the chair, a table, second means extending downwardly from an end portion of said table to support said table on an upper end of said post, said post and at least one of said first and second means enabling said table to pivot in a substantially horizontal plane relative to said plate, and a magazine rack affixed to said wide portion adjacent said first means, said magazine rack comprising two panels affixed to said wide portions and extending upwardly on either side of said first means.

10. In combination, a table assembly and a chair, said assembly comprising stabilizing means defined by a base plate received under chair supports on at least one side of said chair for supporting said assembly, said base plate having a bottom surface defining floor engaging means, an upright post, first means extending upwardly from said base plate to support a lower end of said post on said plate, said post being pivotal on a vertical axis relative to said first means and said plate, a table having an upper flat surface and being elongate in shape and of ample size to hold food, second means extending downwardly from an end portion of said table to support said table on an upper end of said post, means associated with said post to adjust the height of said table relative to said base plate, and a magazine rack affixed to said base plate adjacent said first means, said magazine rack comprising two panels affixed to said base plate and extending upwardly on either side of said first means.

* * * * *

UNITED STATES PATENT AND TRADEMARK OFFICE

CERTIFICATE OF CORRECTION

PATENT NO. : 5,293,825

DATED : March 15, 1994

INVENTOR(S) : Ford B. Cauffiel

It is certified that error appears in the above-identified patent and that said Letters Patent is hereby corrected as shown below:

Column 1, line 10, change "5,,035,464" to --5,035,464--.

Column 1, line 17, delete "is".

Column 2, line 44, after "threaded" delete the ".".

Column 2, line 45, change "SO" to --50--.

Claim 4, line 13, Column 3, line 61, change "plate" to --plane--.

Claim 9, line 18, Column 4, line 58, change "portions" to --portion--.

Signed and Sealed this

Twenty-eighth Day of June, 1994

*Attest:*

Bruce Lehman

BRUCE LEHMAN

*Attesting Officer*

*Commissioner of Patents and Trademarks*

US005293825B1

REEXAMINATION CERTIFICATE (3267th)

United States Patent [19] [11] B1 5,293,825

Cauffiel [45] Certificate Issued Jul. 15, 1997

[54] TV TABLE

[76] Inventor: Ford B. Cauffiel, 4126 Nantucket Dr., Toledo, Ohio 43623

Reexamination Request:
No. 90/003,886, Jul. 3, 1995

Reexamination Certificate for:

| | |
|---|---|
| Patent No.: | **5,293,825** |
| Issued: | **Mar. 15, 1994** |
| Appl. No.: | **950,142** |
| Filed: | **Sep. 24, 1992** |

Certificate of Correction issued Jun. 28, 1994.

[51] Int. Cl.[6] ..... A47B 23/00

[52] U.S. Cl. ..... 108/49; 108/42; 297/144; 297/170; 297/411.23

[58] Field of Search ..... 108/49, 42, 144, 108/106; 297/144, 135, 170, 172, 411.23

[56] References Cited

U.S. PATENT DOCUMENTS

| | | | |
|---|---|---|---|
| 1,312,379 | 8/1919 | Adams . | |
| 1,891,420 | 12/1932 | Jaquith . | |
| 1,898,533 | 2/1933 | Harriman . | |
| 2,681,840 | 6/1954 | Miller | 108/49 X |
| 2,710,051 | 6/1955 | Greenberg | 108/49 X |
| 2,749,197 | 6/1956 | Smith | 108/49 X |
| 3,698,328 | 10/1972 | Weir | 108/49 X |
| 3,747,775 | 7/1973 | Merola . | |
| 3,894,709 | 7/1975 | Weir | 108/49 X |
| 5,038,434 | 8/1991 | Navarrette | 108/49 X |
| 5,104,907 | 4/1992 | Wilkinson | 297/438 X |
| 5,129,702 | 7/1992 | Ervin | 297/149 |
| 5,181,681 | 1/1993 | Edwards | 108/144 X |

FOREIGN PATENT DOCUMENTS

| | | |
|---|---|---|
| 923692 | 7/1947 | France . |
| 3742813 | 7/1989 | Germany . |
| 208625 | 12/1923 | United Kingdom . |
| 407696 | 3/1934 | United Kingdom . |

*Primary Examiner*—Jose V. Chen

[57] ABSTRACT

A TV table assembly for use with a chair has a base plate of a sufficient size to fit under a front leg and a back leg on one side of the chair. A lower sleeve is affixed to and extends upwardly from a forward portion of the base plate. A post has a lower end removably received in the sleeve. A table has a first U-shaped bracket extending downwardly from a lower surface thereof near one end. A second U-shaped bracket has upwardly-extending flanges positioned adjacent the downwardly-extending ones. An upper sleeve is affixed to the second bracket and extends downwardly to removably receive an upper end of the post. A threaded connector extends through both sets of flanges to hold the table in a fixed position relative to a horizontal plane, when tightened. Parallel walls extend upwardly from the base plate and rearwardly of the lower sleeve to serve as a magazine rack.

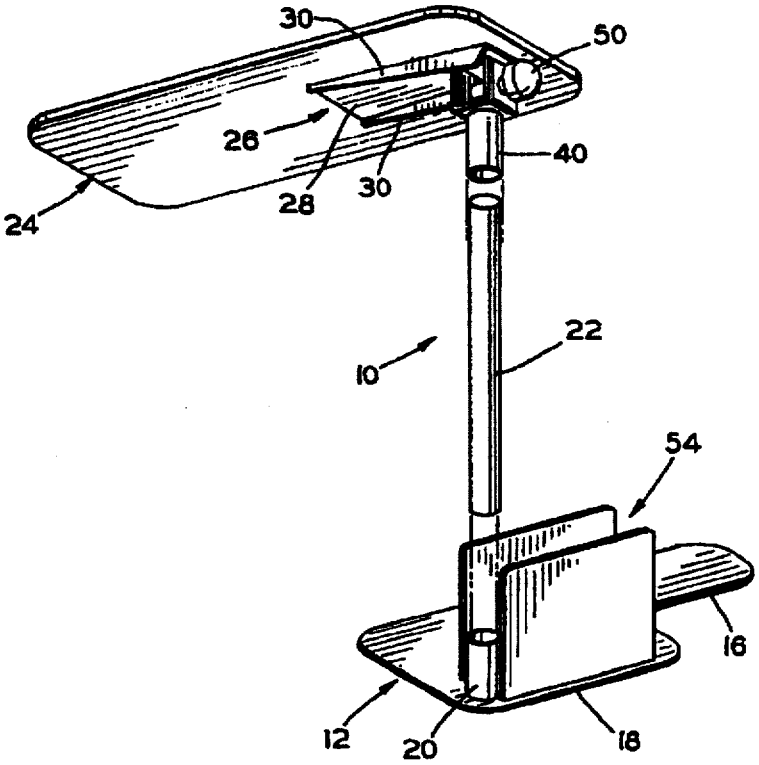

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8, 9 and 10 is confirmed.

Claims 1, 2, 3, 4, 5 and 7 are cancelled.

Claim 6 is determined to be patentable as amended.

New claims 11–14 are added and determined to be patentable.

6. In combination, a table assembly and a chair, said *table* assembly comprising stablizing means defined by *a an elongate* base plate having a bottom surface defining a floor engaging means for contacting a floor under the chair, *said elongate base plate being of uniform thickness throughout its width and length, said base plate having a narrow rear portion and a wide forward portion,* an upright post, first means *located toward an outer edge of said wide portion away from the chair for* extending upwardly from said *elongate* base plate to support a lower end of said *upright* post on said *elongate base* plate, said *upright* post being pivotal on a vertical axis relative to said first means and said *elongate base* plate, a table having an upper flat surface and being elongate in shape and of ample size to hold food, second means extending downwardly from an end portion of said table to support said table on an upper end of said *upright* post so that said table is pivotable in a horizontal plane relative to *elongate* base plate, and means associated with said *upright* post to adjust the height of said table relative to said *elongate* base plate.+cn

*11. A table assembly for use with a chair, said assembly comprising stabilizing means defined by a base plate to be received under and held stationary by chair supports on at least one side of a chair for supporting said assembly, said base plate having a bottom surface for defining a floor engaging means contacting a floor under the chair, an upright post, a lower sleeve affixed to and extending upwardly from said base plate to receive a lower end of said post, said post being pivotal relative to said lower sleeve, a table having an upper flat surface, an upper sleeve extending downwardly from an end portion of said table, said upper sleeve receiving an upper end of said post so that said table is pivotable in a horizontal plane relative to said base plate, bracket means connecting said upper sleeve and said table to enable said table to be moved to a slanted position relative to the horizontal, said bracket means having adjacent flanges, and threaded means extending through said flanges to hold said table in a fixed position relative to the horizontal, and said threaded means including a knob for turning said threaded means to tighten and loosen said flanges to enable said table to be tilted and fixed in a given position.*

*12. In combination, a table assembly and a chair, said table assembly comprising stabilizing means defined by an elongate base plate to be received under and held stationary by chair supports within close proximity to both ends of said elongate base plate on at least one side of the chair for supporting said table assembly, said elongate base plate extending essentially the full length of the chair and having a bottom surface for defining a floor engaging means contacting a floor under the chair, an upright post, a lower sleeve affixed to and extending upwardly from said elongate base plate to receive a lower end of said upright post, said upright post being pivotal relative to said lower sleeve, a table having an upper flat surface, an upper sleeve extending downwardly from an end portion of said table, said upper sleeve receiving an upper end of said upright post so that said table is pivotable in a horizontal plane relative to said elongate base plate.*

*13. In combination, a table assembly and a chair, said table assembly comprising stabilizing means defined by an elongate base plate to be received under and held stationary by chair supports on at least one side of the chair for supporting said table assembly, said elongate base plate being of uniform thickness throughout its width and length, said chair supports being legs which are on said elongate base plate in close proximity to both ends of said elongate base plate, said elongate base plate extending essentially the full length of the chair and having a bottom surface for defining a floor engaging means contacting a floor under the chair, an upright post, a lower sleeve affixed to and extending upwardly from said elongate base plate to receive a lower end of said upright post, said upright post being pivotal relative to said lower sleeve, a table having an upper flat surface, an upper sleeve extending downwardly from an end portion of said table, said upper sleeve receiving an upper end of said upright post so that said table is pivotal in a horizontal plane relative to said elongate base plate.*

*14. In combination, a table assembly and a chair, said table assembly comprising stabilizing means defined by an elongate base plate received under and held stationary by chair supports within close proximity to both ends of said elongate base plate on at least one side of said chair for supporting said table assembly, said elongate base plate having a bottom surface defining a floor engaging means for contacting a floor under the chair, said elongate base plate being of uniform thickness throughout its width and length, said elongate base plate extending essentially the full length of the chair, an upright post, first means for extending upwardly from said elongate base plate to support a lower end of said upright post on said elongate base plate, said upright post being pivotal on a vertical axis relative to said first means and said elongate base plate, a table having an upper flat surface and being elongate in shape and of ample size to hold food, second means extending downwardly from an end portion of said table to support said table on an upper end of said upright post so that said table is pivotable in a horizontal plane relative to said elongate base plate, and means associated with said upright post to adjust the height of said table relative to said elongate base plate.*

* * * * *